US006926102B2

(12) United States Patent
Hess et al.

(10) Patent No.: US 6,926,102 B2
(45) Date of Patent: Aug. 9, 2005

(54) SUBSEA CONTROLLED MILLING

(75) Inventors: Joseph E. Hess, Anchorage, AK (US); Neil Hepburn, Edmonton (CA); Benji Smith, Spring, TX (US); John J. Guerrero, Houston, TX (US); Ian W. Thackwray, Perth (AU)

(73) Assignee: Halliburton Energy Services, Inc., Houston, TX (US)

( * ) Notice: Subject to any disclaimer, the term of this patent is extended or adjusted under 35 U.S.C. 154(b) by 335 days.

(21) Appl. No.: 10/377,138

(22) Filed: Feb. 28, 2003

(65) Prior Publication Data

US 2004/0168829 A1 Sep. 2, 2004

(51) Int. Cl.[7] ..... E21B 23/08
(52) U.S. Cl. ..... 175/97; 175/99; 175/321
(58) Field of Search ..... 175/97, 98, 99, 175/61, 321

(56) References Cited

U.S. PATENT DOCUMENTS

| | | | | |
|---|---|---|---|---|
| 1,669,898 A | | 5/1928 | Chase | |
| 3,799,277 A | * | 3/1974 | Kellner | 175/94 |
| 5,555,946 A | | 9/1996 | Klatt | |
| 5,944,103 A | | 8/1999 | White et al. | |
| 6,070,670 A | * | 6/2000 | Carter et al. | 166/381 |
| 6,116,344 A | | 9/2000 | Longbottom et al. | |
| 6,206,108 B1 | * | 3/2001 | MacDonald et al. | 175/24 |
| 6,286,592 B1 | | 9/2001 | Moore et al. | |
| 6,286,614 B1 | | 9/2001 | Gano et al. | |
| 6,364,037 B1 | * | 4/2002 | Brunnert et al. | 175/61 |
| 6,382,323 B1 | * | 5/2002 | Gano et al. | 166/382 |
| 6,550,551 B2 | * | 4/2003 | Brunnert et al. | 175/61 |

FOREIGN PATENT DOCUMENTS

| | | |
|---|---|---|
| GB | 2129350 | 5/1984 |
| GB | 2340526 | 2/2000 |
| GB | 2360801 | 10/2001 |
| WO | WO 98/50668 A1 | 11/1998 |

OTHER PUBLICATIONS

Sperry–Sun drawing No. C00466.
Sperry–Sun brochure describing "Sperry LOCK".
Oil & Gas Journal article entitled, "Classification Provides Framework for Ranking Multilateral Complexity and Well Type," dated Dec. 29, 1997.
Weatherford Web Page Printout entitled, "Subsea Downhole Motion Compensator" dated 2003.
Weatherford Presentation entitled "Extended Reach Drilling," dated Sep. 9, 1999.
Sperry–Sun drawing No. 083310.
Sperry–Sun drawing No. 083323.
Sperry–Sun drawing No. 083340.
Sperry–Sun drawing No. 084410.
Sperry–Sun drawing No. 084413.
Sperry–Sun drawing No. 084416.
Sperry–Sun drawing No. 081725.
Sperry–Sun drawing of "retainer".
Sperry–Sun drawing of "slip carrier".
Search Report for U.K. Application No. GB 0403983.0.
9.625" Cut on Depth Tool by Sperry–Sun.

* cited by examiner

*Primary Examiner*—Frank Tsay
(74) *Attorney, Agent, or Firm*—Marlin R. Smith

(57) ABSTRACT

Subsea controlled milling apparatus and methods. In a described embodiment, a method of controlling displacement of a cutting device conveyed on a tubular string in a subterranean well includes the steps of: interconnecting an apparatus in the tubular string, the apparatus including an axial advancement device and an anchoring device; actuating the anchoring device to anchor the apparatus in the well; applying a pressure differential to the advancement device, thereby displacing the cutting device relative to the apparatus; and operating the cutting device to cut a structure in the well.

26 Claims, 9 Drawing Sheets

SUBSEA CONTROLLED MILLING

BACKGROUND OF THE INVENTION

The present invention relates generally to drilling, milling and similar operations performed in conjunction with a subterranean well and, in an embodiment described herein, more particularly provides controlled milling in subsea wells.

It is frequently desirable to isolate a cutting device, such as a drill bit or a mill, from the motion of a tubular string on which the cutting device is carried. For example, where a cutting operation is being performed from a floating rig (sometimes referred to as a "floater"), the tubular string suspended from the floater may rise and fall due to a heaving motion of the rig. Some floaters may be equipped with devices known as heave motion compensators, but these devices are not typically capable of removing all rising and falling motion from a suspended tubular string.

In some circumstances, accurate axial advancement of the cutting device in the well may be required. This accurate advancement is compromised by the rising and falling of the tubular string. For example, the cutting device may be a mill which may be damaged if the mill suddenly impacts a structure downhole. Of course, many other circumstances also require accurate axial advancement of a cutting device, whether the operations are performed from a floater or a land-based rig.

From the foregoing, it can be seen that it would be quite desirable to provide an apparatus which permits accurate axial advancement of a cutting device. It is accordingly an object of the present invention to provide such an apparatus and associated methods of controlling displacement of a cutting device in a well.

SUMMARY OF THE INVENTION

In carrying out the principles of the present invention, in accordance with an embodiment thereof, an apparatus is provided which includes an anchoring device and an axial advancement device. The apparatus is specially configured to control a milling operation in a subsea well. Associated methods are also provided.

In one aspect of the present invention, method of controlling displacement of a cutting device conveyed on a tubular string in a subterranean well is provided. The method includes the steps of: interconnecting an apparatus in the tubular string, the apparatus including an axial advancement device and an anchoring device; actuating the anchoring device to anchor the apparatus in the well; applying a pressure differential to the advancement device, thereby displacing the cutting device relative to the apparatus; and operating the cutting device to cut a structure in the well.

In another aspect of the invention, a system for controlling displacement of a cutting device in a cutting operation in a subterranean well is provided. The system includes the cutting device interconnected at a lower end of a tubular string; and an apparatus interconnected in the tubular string above the cutting device. The apparatus includes an anchoring device operative to anchor the apparatus in the well, and an advancement device responsive to a pressure differential in the apparatus. The advancement device controls axial displacement of the cutting device relative to the apparatus.

In yet another aspect of the invention, an apparatus for controlling displacement of a cutting device in a subterranean well is provided. The apparatus includes an advancement device responsive to a pressure differential in the apparatus to axially displace the cutting device relative to the apparatus and an anchoring device configured to anchor the apparatus in the well.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
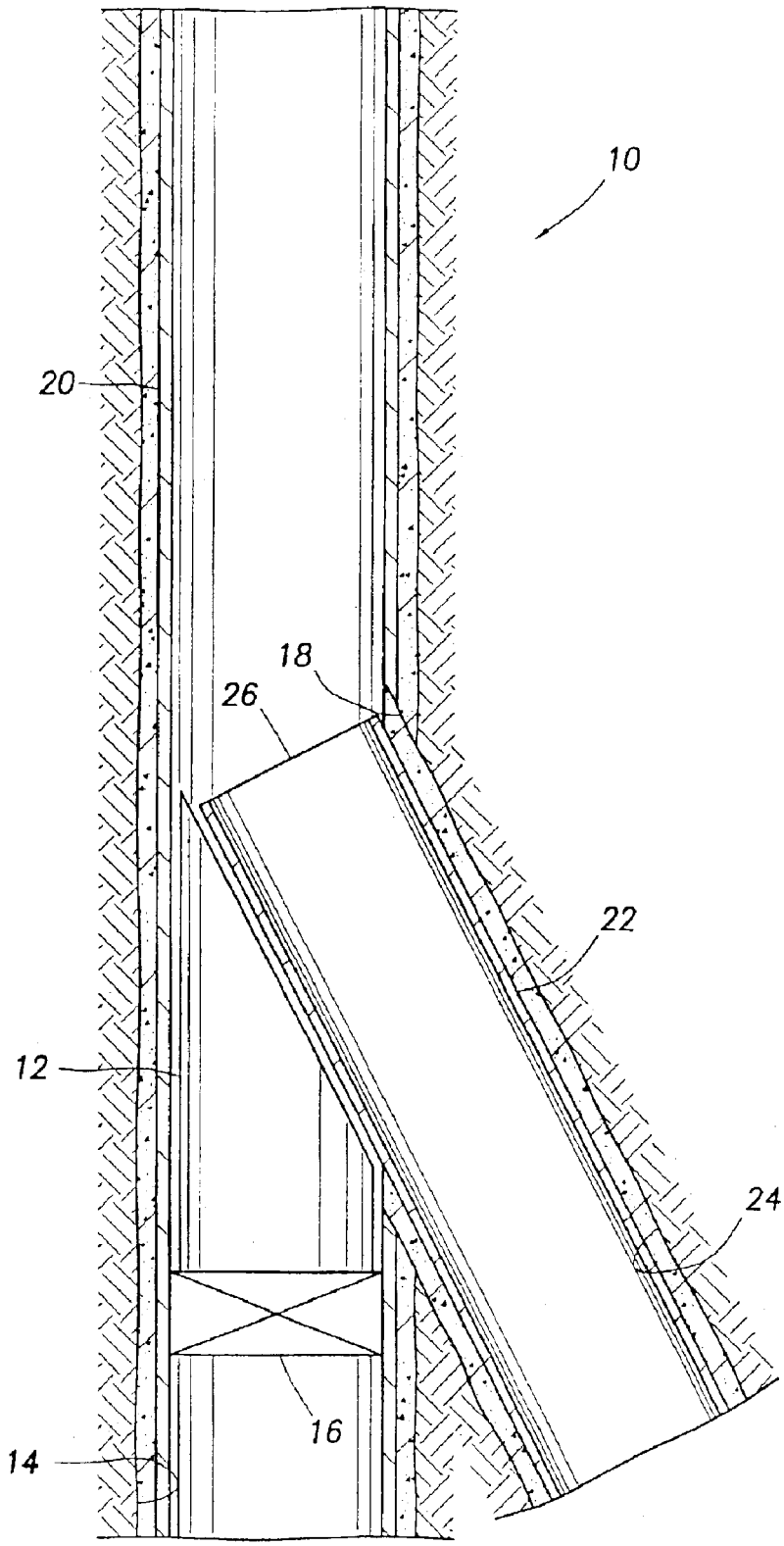
FIG. 1 is a schematic cross-sectional view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10 as depicted in FIG. 1, a whipstock 12 has been anchored in a parent or main wellbore 14 using an anchoring device 16, such as a packer. A window 18 has been milled through casing 20 lining the wellbore 14 by deflecting one or more cutting devices, such as mills, (not shown) off of the whipstock 12. A branch or lateral wellbore 24 has been formed extending outwardly from the window 18 by deflecting one or more other cutting devices, such as drill bits, (not shown) off of the whipstock 12. A liner 22 has been positioned in the lateral wellbore 24 by deflecting it off of the whipstock 12, and the liner is cemented within the lateral wellbore.

Note that a transition joint or upper end portion 26 of the liner 22 remains in the parent wellbore 14, partially blocking the wellbore. Although not specifically illustrated in FIG. 1, the upper end 26 would preferably extend axially upward farther within the casing 20. Additionally, the whipstock 12 and packer 16 should be removed if access to the parent wellbore 14 below its intersection with the lateral wellbore 24 is desired. Preferably, the upper end 26 of the liner 22 extending through the window 18 would be cut off and the whipstock 12 would be retrieved in a single trip into the well. However, this method generally requires the use of a cutting device known to those skilled in the art as a washover tool or burning shoe (not shown in FIG. 1) having a relatively thin wall thickness, due to the small space radially between the whipstock 12 and the casing 20.

The thin walled washover tool is used to cut off the upper end 26 of the liner 22, to washover the whipstock 12, and to release the whipstock from the packer 16. Unfortunately, however, if the method 10 is performed from a floater, it may be very difficult to control the advancement of the washover tool in this operation. Thus, the washover tool may abruptly contact the upper end 26 of the liner 22, thereby damaging the tool, or, after cutting has commenced, it may be very difficult to maintain relatively uniform advancement of the washover tool. Furthermore, if a mud motor is used to drive the washover tool, and the motor stalls during the cutting operation, it may be very difficult to accurately disengage the washover tool from the structure being cut, and then to begin the cutting operation again. This situation makes it hazardous and inefficient to perform such cutting operations from a floater. Of course, similar situations may arise with land-based rigs (i.e., the need for accurate advancement of a downhole cutting device), and so it is to be clearly understood that the principles of the present invention are not limited to use in operations performed from a floater.

Figure 2:
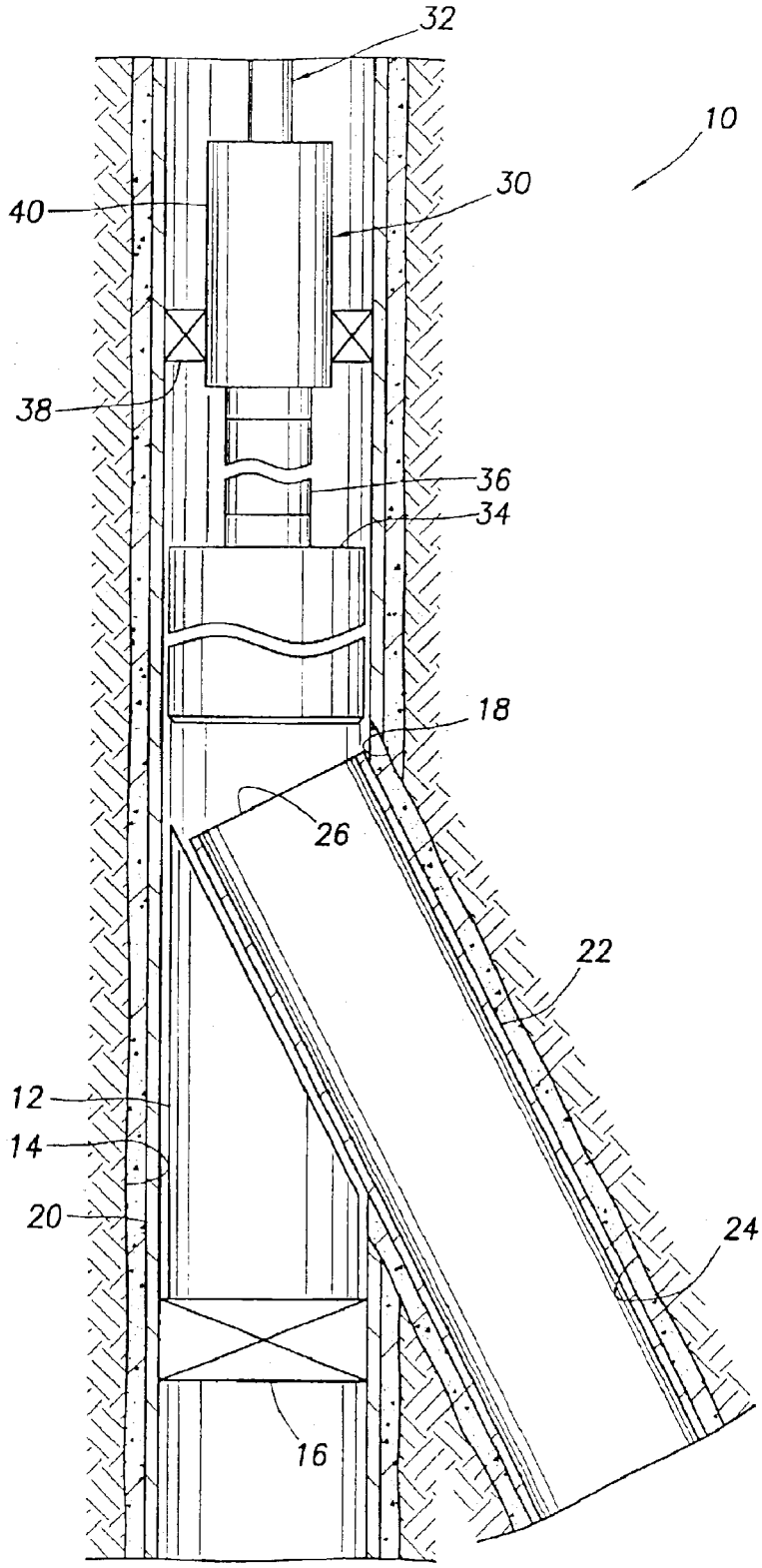
FIG. 2 is a schematic view of the method of FIG. 1, wherein further steps of the method are being performed.
Figure 3:
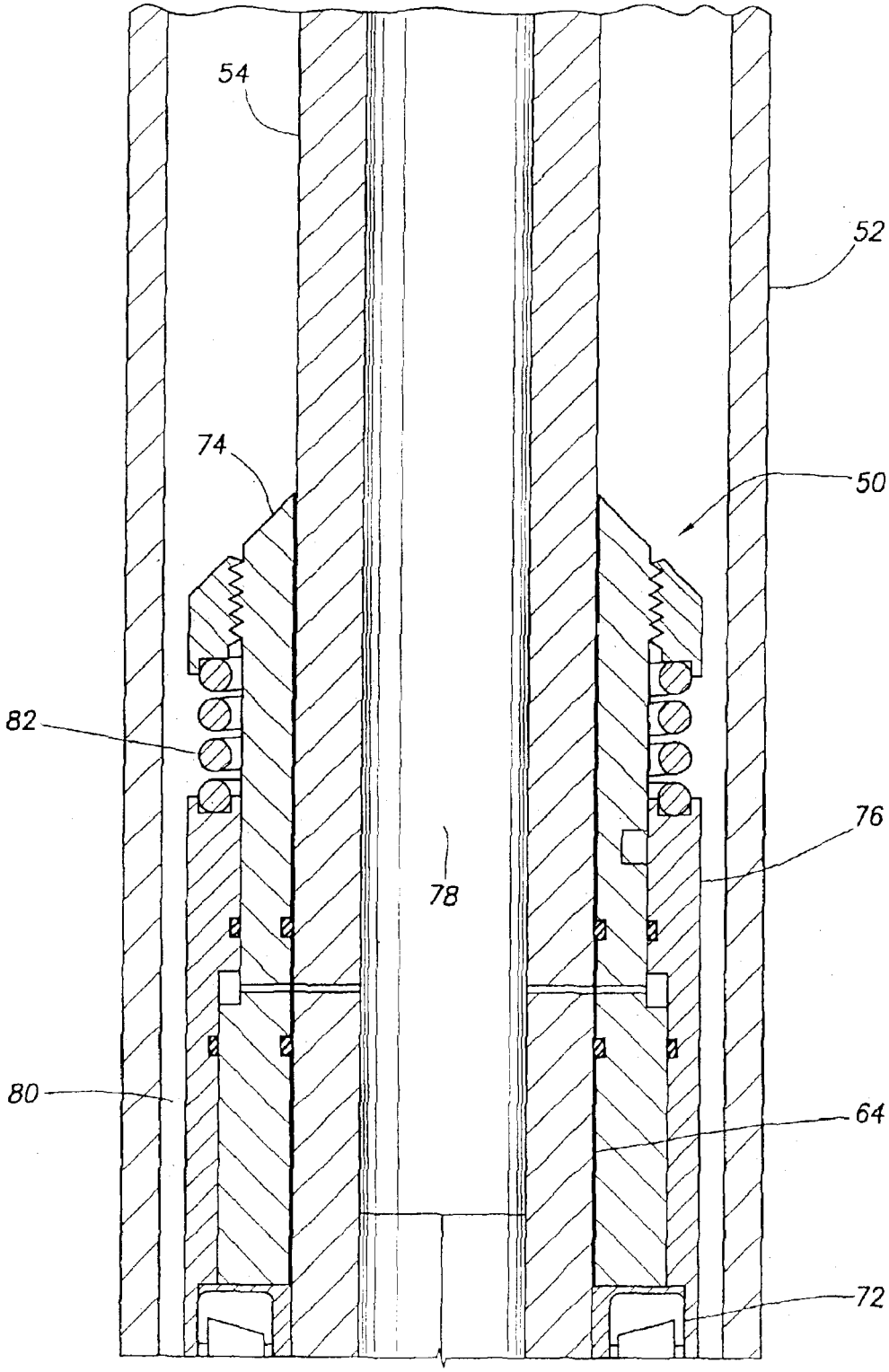
FIGS. 3–9 are schematic cross-sectional views of successive axial portions of a subsea milling apparatus embodying principles of the present invention.
Figure 4:
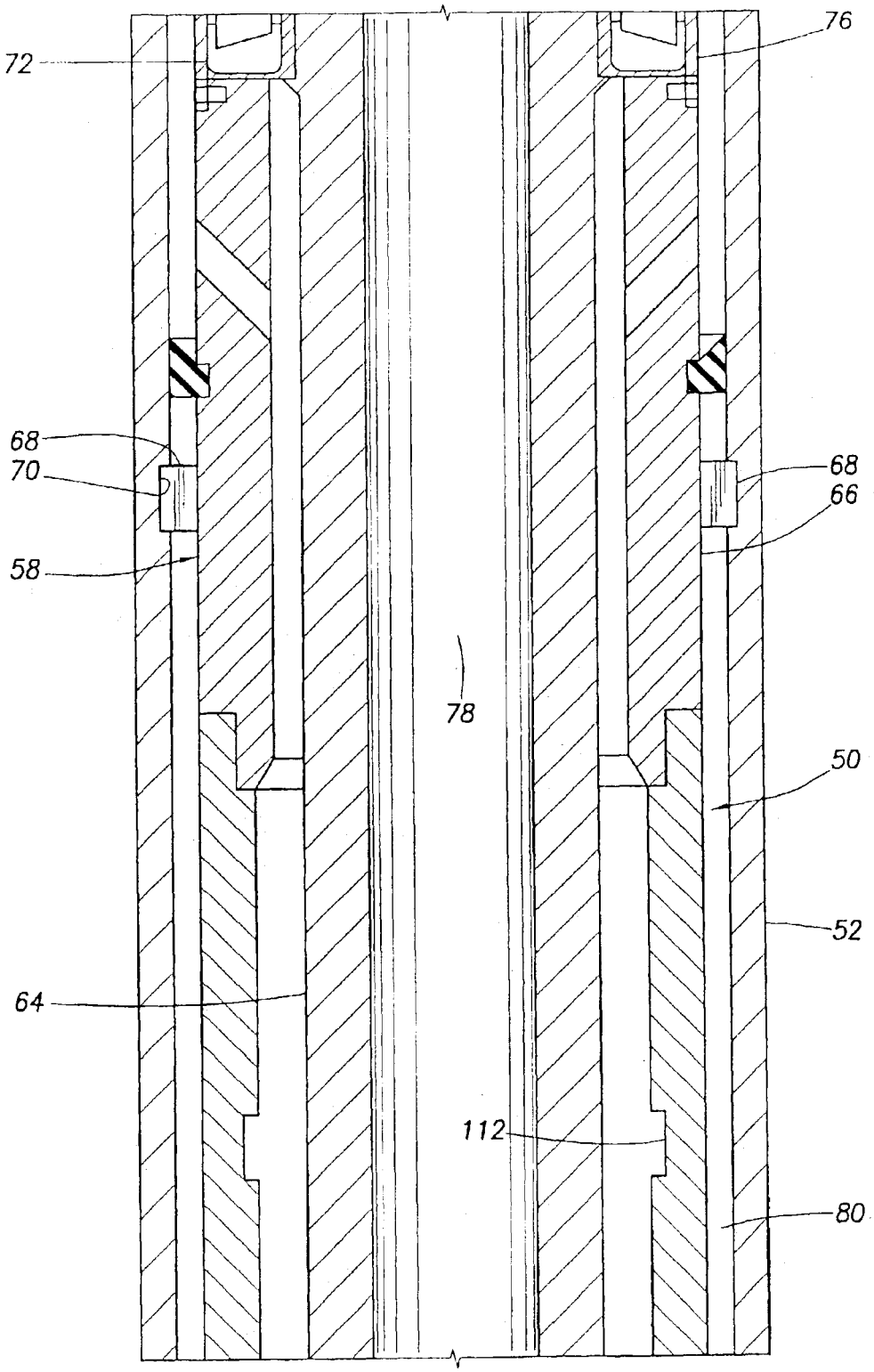
Figure 5:
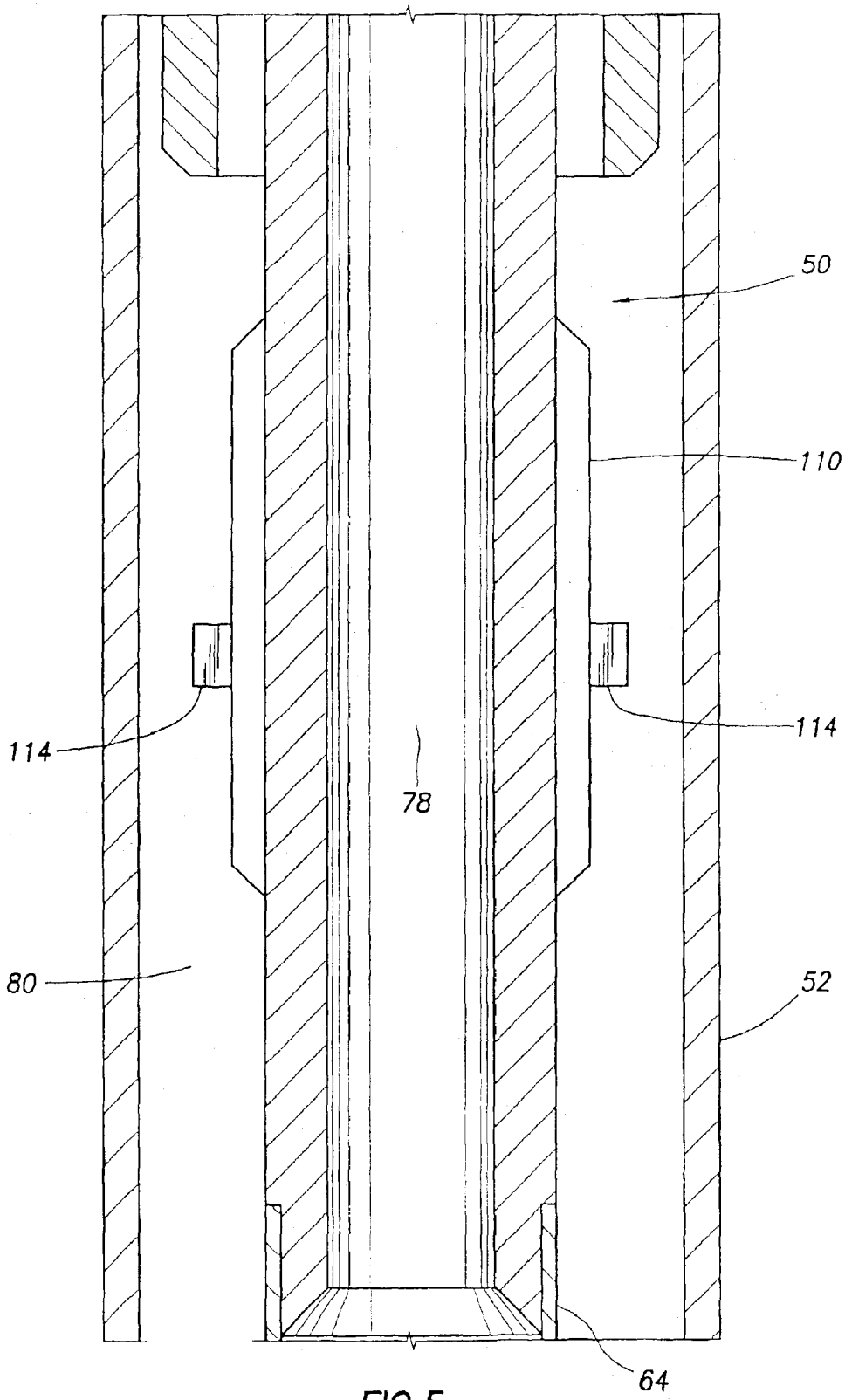
Figure 6:
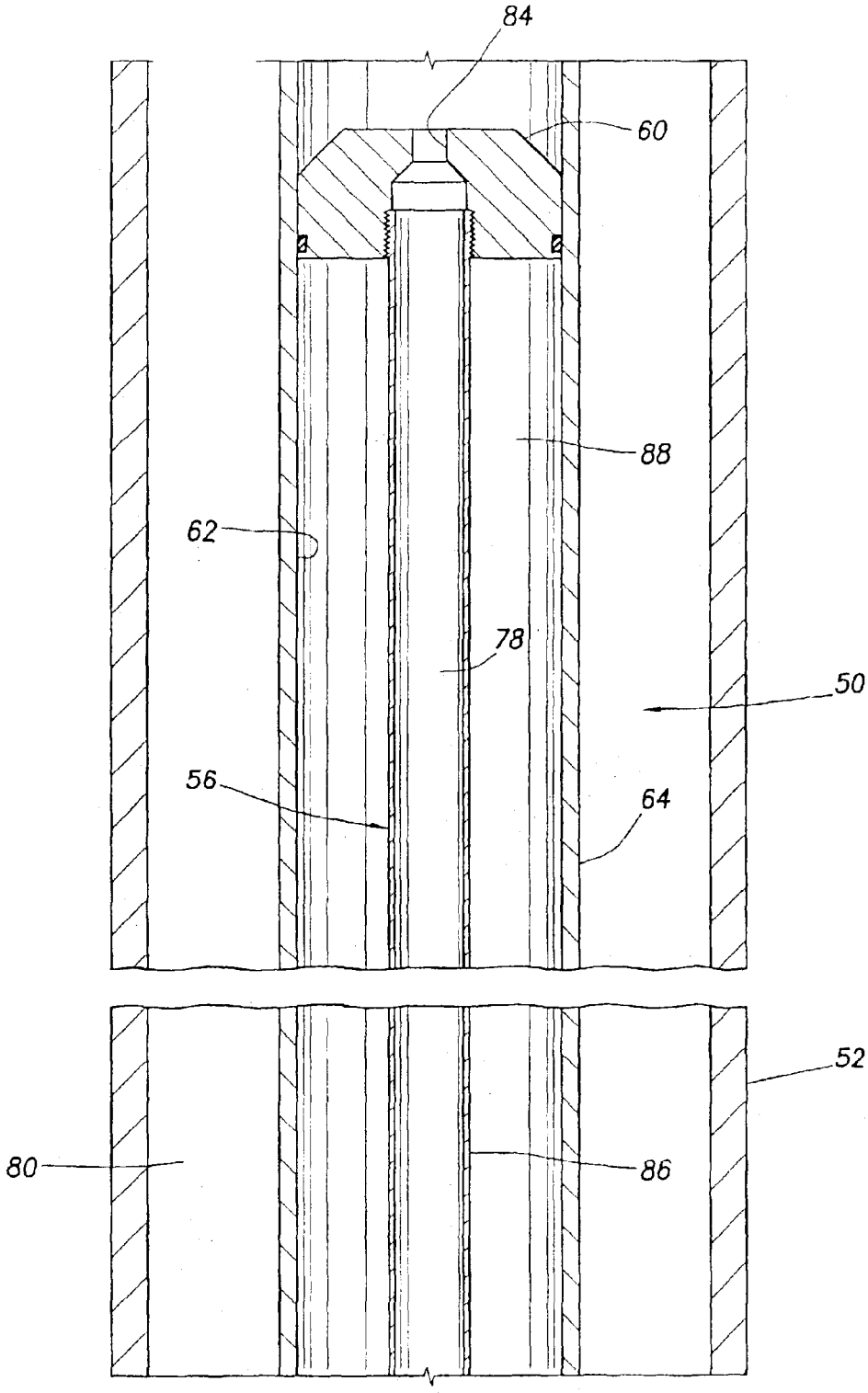
Figure 7:
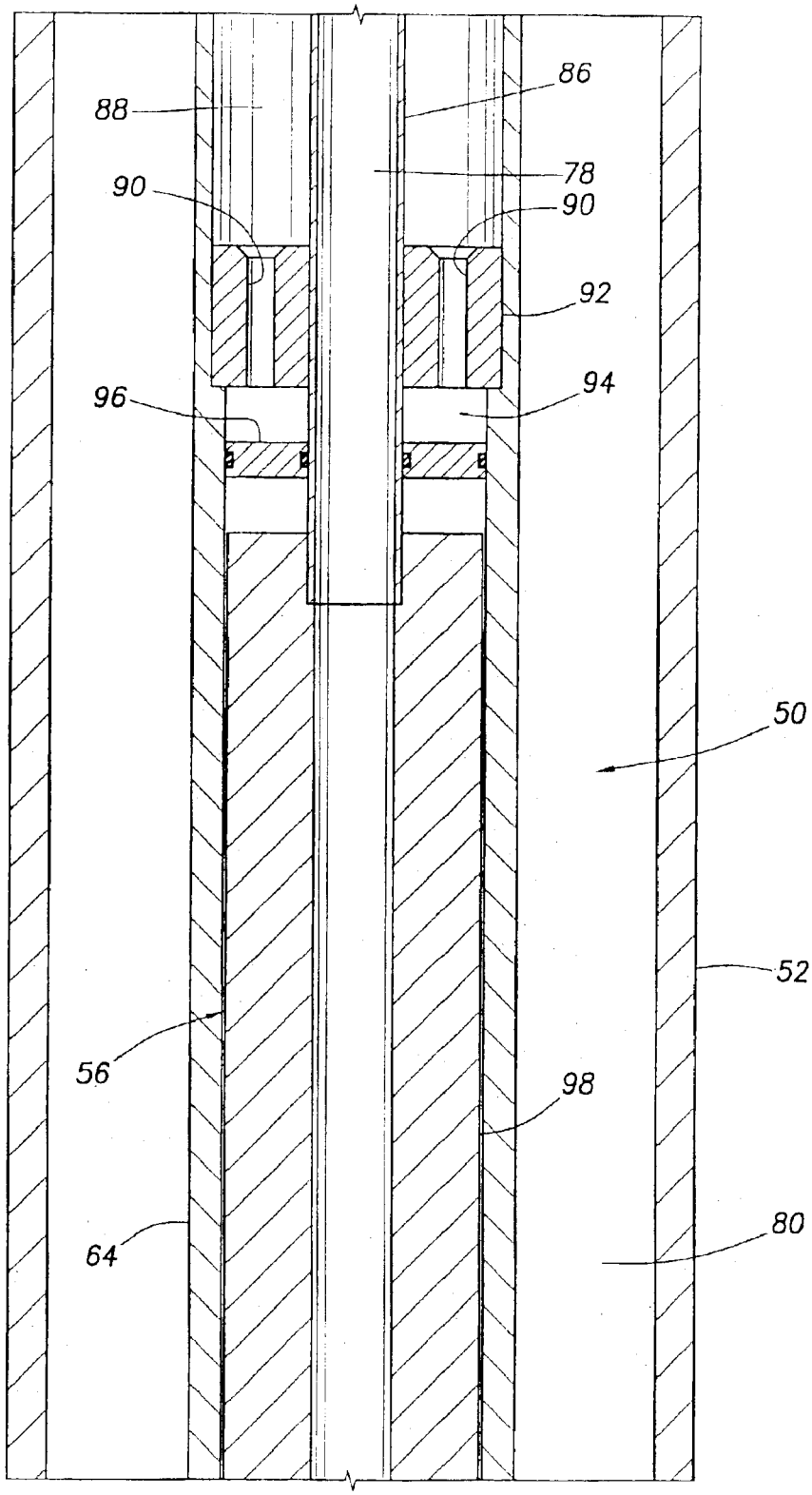

Referring additionally now to FIG. 2, the method 10 is depicted in which additional steps have been performed. A milling apparatus 30 embodying principles of the present invention has been interconnected in a tubular string 32, such as a drill string, above a cutting device 34, such as a burning shoe or washover tool. A downhole motor 36, such as a mud motor, which is operated by circulating fluid through the drill string 32, may be interconnected between the milling apparatus 30 and the washover tool 34. Alternatively, the washover tool 34 may be rotated by rotating the drill string 32, as described below. It is to be clearly understood that cutting devices other than the washover tool 34 and driving means other than the motor 36 or drill string 32 may be utilized in methods and apparatus incorporating principles of the present invention.

The milling apparatus 30 functions to isolate the washover tool 34 from the upward and downward motion of the drill string 32 thereabove. Thus, if the drill string 32 at the surface is rising and falling, this rising and falling motion is not transmitted to the washover tool 34. This result is accomplished by including an anchoring device 38 and an advancement device 40 in the milling apparatus 30.

The anchoring device 38 secures the milling apparatus 30 in position in the wellbore 14, isolating the washover tool 34 from the rising and falling motion of the drill string 32 above the milling apparatus, while the advancement device 40 displaces the washover tool 34 and motor 36 (and the remainder of the drill string 32 below the milling apparatus) toward the structure to be cut. The advancement device 40 also includes a recocking or restroking feature which permits the washover tool 34 to be repositioned lower in the casing 20 during the milling operation (e.g., to cut further through the structure being cut), or retracted out of engagement with the structure being cut (e.g., in the event that the motor 36 stalls), and then to be advanced again into contact with the structure.

Referring additionally now to FIGS. 3–9, a milling apparatus 50 embodying principles of the present invention is representatively illustrated. The milling apparatus 50 may be used for the milling apparatus 30 in the method 10, or it may be used in other methods. In FIGS. 3–9, the milling apparatus 50 is depicted received within casing 52 and interconnected in a tubular string 54.

The milling apparatus 50 includes an advancement device 56 and an anchoring device 58. The advancement device 56 includes a piston 60 reciprocably and sealingly received within a bore 62 formed in a mandrel assembly 64. The anchoring device 58 includes a latch assembly 66 having keys or collets 68 which engage a radially enlarged internal profile or recess 70 formed in the casing 52.

The milling apparatus 50 is positioned and anchored in a well by engaging the keys 68 with the profile 70. An appropriate latch assembly for use as the latch assembly 66, and an appropriate latch coupling having an internal profile for use as the profile 70, are described in U.S. Pat. No. 6,202,746, the entire disclosure of which is incorporated herein by this reference. The keys 68 of the latch assembly 66 engage the profile 70 as the apparatus 50 is lowered through the casing 52. Engagement between the keys 68 and the profile 70 prevents further axially downward movement of the apparatus 50 relative to the casing 52, and preferably also prevents rotation of the apparatus within the casing.

Note that other types of anchoring devices may be used instead of the latch assembly 66 and profile 70. For example, a hanger or packer having outwardly extendable slips could be used to anchor the apparatus 50 in the casing 52. As another example, the latch assembly and coupling described in U.S. Pat. No. 6,382,323, the entire disclosure of which is incorporated herein by this reference, may be used.

After the anchoring device 58 anchors the apparatus 50 in the casing 52, at least a portion of the weight of the string 54 is placed on the milling apparatus 50 by, for example, slacking off on the string at the surface. The string 54 is, thus, placed at least partially in compression above the milling apparatus 50, thereby preventing any rising and falling motion of the upper end of the string from being transmitted through the milling apparatus. As depicted in FIGS. 3–9, weight of the string 54 has been placed on the apparatus 50 after it has been anchored in position within the casing 52.

If a hanger or packer is used as the anchoring device 58, then weight of the string 54 may be placed on the apparatus 50 in order to engage slips of the hanger or packer with the casing 52. If the latch assembly and coupling described in the above-referenced U.S. Pat. No. 6,382,323 is used, then tension instead of compression is applied to the milling apparatus 50 by the string 54 after the latch engages the coupling.

The mandrel 64 is attached to the tubular string 54, so that rotation of the tubular string at the surface also rotates the mandrel in the apparatus 50. A bearing assembly 72 is interconnected between the mandrel 64 and the latch assembly 66 to permit rotation of the mandrel relative to the latch assembly after the apparatus 50 has been anchored in the casing 52 and weight of the string 54 has been placed on the apparatus. Thus, the bearing assembly 72 supports the weight of the string 54 placed on the apparatus 50 after the anchoring device 58 secures the apparatus relative to the casing 52.

If the latch assembly 66 is of the type described in the U.S. Pat. No. 6,202,746 referred to above, then full engagement of the keys 68 in the profile 70 may require that the latch assembly be rotated within the casing 52 to appropriately align the keys with the profile. This rotation of the latch assembly 66 is accomplished by providing a clutch assembly 74 between the mandrel 64 and the latch assembly. The clutch assembly 74 includes a piston 76 which is displaced upward when a pressure differential exists between an internal longitudinal passage 78 formed through the apparatus 50, and an annulus 80 formed between the apparatus and the casing 52. Specifically, the pressure differential is between a pressure in a portion of the passage 78 above the piston 60 and pressure in the annulus 80.

The piston 76 is displaced upward against a biasing force exerted by a spring 82 when the pressure differential is sufficiently large to produce an upwardly directed force on the piston greater than a downwardly directed force exerted by the spring. Thus, when the pressure differential is sufficiently large, the piston 76 displaces upward and thereby disconnects the mandrel 64 from the latch assembly 66 (i.e. rotation of the mandrel relative to the latch assembly is permitted, and rotation of the mandrel will not produce rotation of the latch assembly), and when the pressure differential is not large enough to upwardly displace the piston, the mandrel is connected to the latch assembly (i.e., rotation of the mandrel relative to the latch assembly is not permitted, and rotation of the mandrel produces rotation of the latch assembly).

When the apparatus 50 is being positioned in the well and the keys 68 are being engaged in the profile 70, the pressure differential from the passage 78 above the piston 60 to the annulus 80 is preferably not sufficiently large to upwardly displace the piston 76. Thus, the mandrel 64 may be rotated (e.g., by rotating the string 54 at the surface) to produce rotation of the latch assembly 66 and thereby fully engage the keys 68 in the profile 70. When the milling process is initiated, as described more fully below, the pressure differential is sufficiently large to upwardly displace the piston 76 and permit relative rotation between the mandrel 64 and the latch assembly 66.

If, however, rotation of the string 54 is not used to rotate a cutting device 106 below the apparatus 50 (see FIG. 9), then the clutch assembly 74 may be eliminated from the apparatus. This would be the case if the mud motor 36 is used instead to rotate the cutting device 106.

The piston 60 displaces in response to a pressure differential in the passage 78. Specifically, the piston 60 is displaced downward by a differential between pressure in the passage 78 above the piston and pressure in the passage below the piston. For this purpose, the piston 60 includes a flow restricting orifice 84. When fluid is circulated down the passage 78, the orifice 84 creates a pressure drop from above to below the piston 60. This pressure drop or pressure differential biases the piston 60 downwardly.

The passage 78 extends through a tube 86 attached to the piston 60 and extending downwardly therefrom. An annulus 88 is formed between the tube 86 and the mandrel 64. A fluid, such as silicone oil or another hydraulic fluid, is contained in the annulus 88. As the piston 60 displaces downward, the fluid is displaced downward with the piston.

One or more flow restricting orifices go are formed through a bulkhead 92 at a lower end of the annulus 88. These orifices go meter the fluid flowing downward from the annulus 88 into another annulus 94 therebelow. This metering of the fluid flowing through the orifices go is used to control the rate of downward displacement of the piston 60 and tube 86.

The orifices go may be enlarged to produce an increased rate of displacement, or the orifices may be made smaller to produce a slower displacement of the piston 60 and tube 86. A floating piston 96 is used to separate the clean hydraulic fluid in the annulus 94 from well fluid therebelow.

The tube 86 is attached to a lower tubular extension 98. The extension 98 is reciprocably received within the mandrel assembly 64 and extends downwardly therefrom through a bushing 100 at a lower end of the mandrel assembly.

The bushing 100 is of the type well known to those skilled in the art as a "kelly" bushing. The bushing 100 transmits torque from the mandrel assembly 64 to the extension 98 by preventing relative rotation therebetween. However, the bushing 100 does permit the extension 98 to displace axially therethrough.

Figure 8:
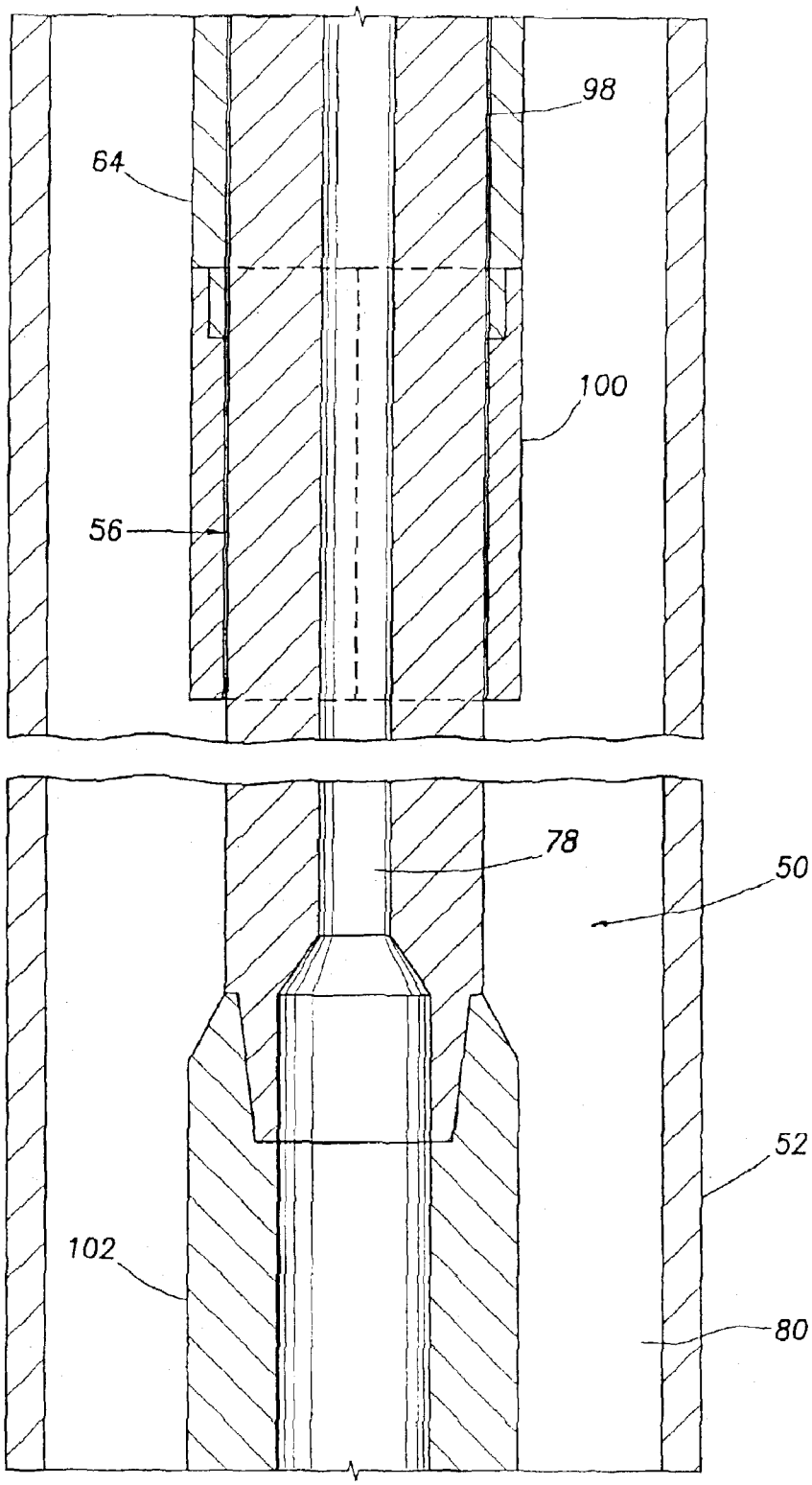
Figure 9:
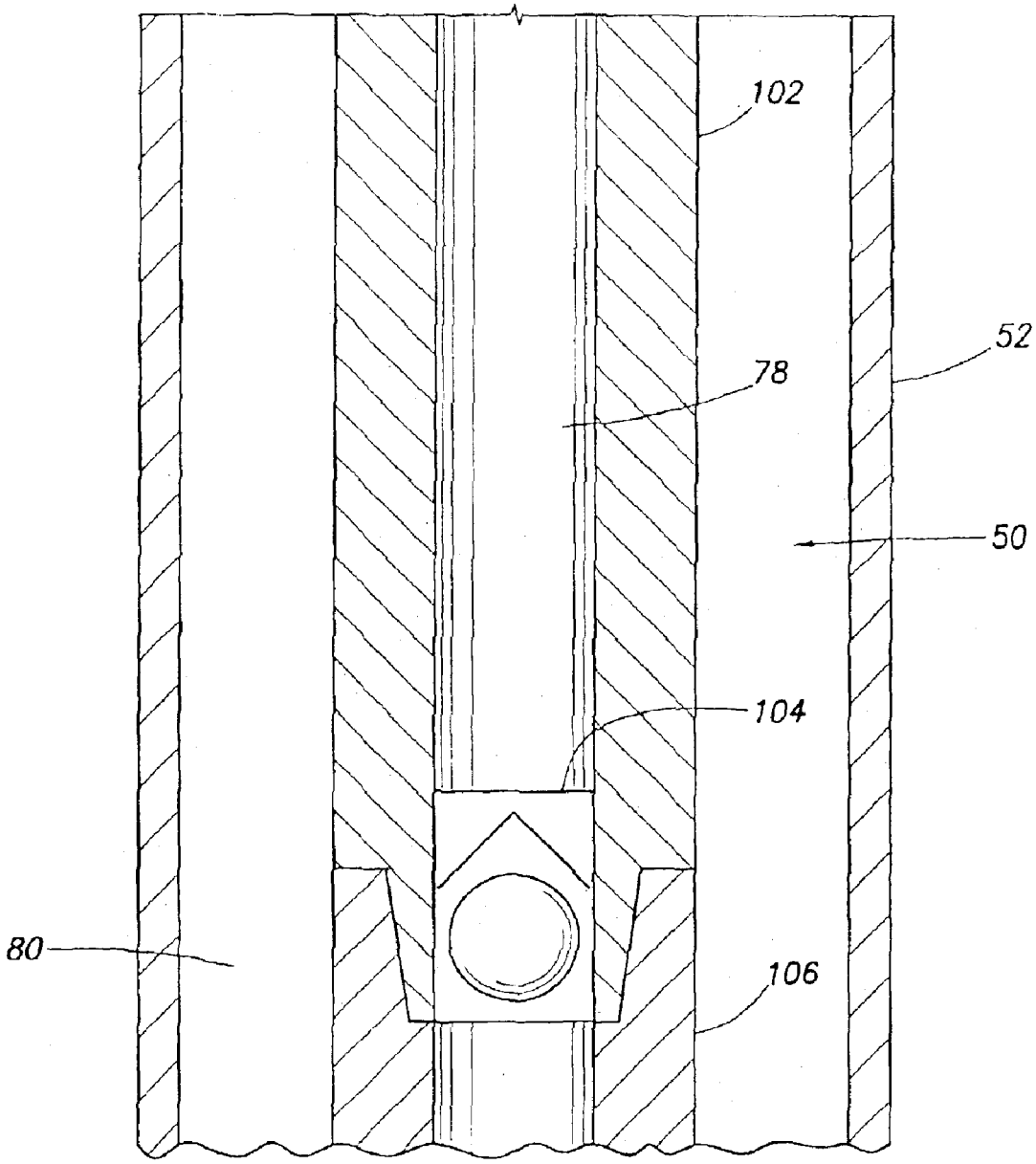

For this purpose, the extension 98 preferably has a square-shaped outer side surface which is reciprocably received within a complementarily shaped inner side surface of the bushing 100 (indicated by dashed lines in FIG. 8). It should be understood that other shapes of the extension 98 and bushing 100 surfaces may be used in keeping with the principles of the invention, such as hexagonal, octagonal, etc. Furthermore, other means may be utilized for permitting relative axial displacement while preventing relative rotation between the extension 98 and the bushing 100, such as a splined connection, a pin received in an axial slot, etc.

If, however, rotation of the string 54 is not used to rotate the cutting device 106 below the apparatus 50, then the extension 98 and the bushing 100 may be eliminated from the apparatus. This would be the case if the mud motor 36 is used instead to rotate the cutting device 106.

The extension 98 is connected at its lower end to a tubular sub 102 having a check valve 104 therein. The check valve 104 permits downward flow through the passage 78, but prevents flow in the opposite direction. The check valve 104 could be, for example, a conventional float valve.

The sub 102 is connected at its lower end to the cutting device 106, such as the burning shoe or washover tool 34 in the method 10 described above. Of course, there may in actual practice be other equipment connected between the sub 102 and the cutting device 106, for example, to appropriately position the cutting device and apparatus 50 relative to each other and relative to the structure being cut in the well.

Operation of the apparatus 50 is described below as if the apparatus is used in the method 10, it being understood that this is merely an example of a wide variety of methods in which the apparatus may be used.

The profile 70 is preferably interconnected in the casing 20 a known distance from the structure to be cut in the well (in this case the upper end 26 of the liner 22) when the casing is installed in the well. Of course, at this time the liner 22 has not yet been installed, so the profile 70 is positioned a known distance from the intended location of the upper end 26 of the liner 22. Alternatively, the profile 70 may be formed in the casing 20 after it is installed in the well, for example, as described in U.S. patent application Ser. No. 10/147,567, filed May 16, 2002, the entire disclosure of which is incorporated herein by this reference. As another alternative, the apparatus 50 may be provided with another type of anchoring device, such as the anchoring device described in U.S. Pat. No. 6,286,614, the entire disclosure of which is incorporated herein by this reference.

After the casing 20 is installed and cemented in the parent wellbore 14, the whipstock 12 and packer 16 are installed in the casing below the intended location for the window 18. Then the window 18 is milled and the lateral wellbore 24 is drilled through the window. The liner string 22 is positioned in the lateral wellbore 24, with the upper end 26 of the liner extending into the casing 12.

The apparatus 50 is interconnected in the drill string 32 above the cutting tool 34. The drill string 32 is lowered in the parent wellbore 14 until the keys 68 engage the profile 70. At this point, the pressure differential from the passage 78 to the annulus 80 is either not present, or is not sufficiently large to actuate the clutch assembly 74 and rotationally disconnect the string 32 from the latch assembly 66.

Thus, the string 32 may be rotated to rotate the latch assembly 66 and fully engage the keys 68 in the profile 70. This engagement between the keys 68 and the profile 70 both rotationally and axially anchors the apparatus 50 in the casing 20, although it is not necessary for the apparatus to be rotationally anchored in the casing.

Once the apparatus 50 is anchored in the casing 20, sufficient weight of the string 32 (e.g., 10,000 lb.) is placed on the apparatus to isolate the apparatus from the rising and falling motion of the upper end of the string. Fluid is then circulated down the string 32 and through the passage 78 to the annulus 80 for return to the surface. This fluid flow creates a pressure differential from the passage 78 above the piston 60 to the annulus 80 due to the flow restricting orifice 84 in the piston.

The pressure differential causes the piston 76 of the clutch assembly 74 to rise and rotationally disconnect the latch assembly 66 from the mandrel 64. The string 32 may now be rotated to rotate the mandrel 64, without also rotating the latch assembly 66. The weight of the string 32 applied to the apparatus 50 is borne by the bearing assembly 72, permitting relatively unhindered rotation of the mandrel 64 relative to the latch assembly 66.

The pressure differential in the passage 78 from above to below the piston 60 causes the piston to displace downward. This downward displacement of the piston 60 is metered by the flow restricting orifices go in the bulkhead 92. Thus, downward advancement of the washover tool 34 (which is connected to the piston 60 via the tube 86, extension 98 and sub 102) is in a controlled manner, isolated from any rising and falling motion of the upper end of the string 32.

Rotation of the mandrel 64 is transferred to the extension 98 via the kelly bushing 100. Thus, the washover tool 34 is rotated by rotation of the string 32. Alternatively, the mud motor 36 could be interconnected between the apparatus 50 and the washover tool 34, so that the circulation of fluid through the passage 78 and thence through the mud motor would cause rotation of the washover tool.

In this manner, the washover tool 34 is rotated and axially advanced in a controlled manner, even though the upper end of the string 32 may be rising and falling. If it is desired to cut farther through a structure than is available in a single stroke of the apparatus 50, then the apparatus may be recocked downhole. This recocking is accomplished by ceasing the circulation of fluid through the passage 78, disengaging the latch assembly 66 from the profile 70, for example, by picking up on the string 32, and then slacking off on the string with the washover tool 34 remaining in contact with the structure being cut. This will apply an upwardly directed force to the sub 102, extension 98 and tube 86, thereby forcing the piston 60 to displace upwardly. The apparatus 50 may then be anchored in the casing 20 again, either in the same position as before, or in a more downwardly disposed position, and the cutting operation may be resumed by circulating fluid through the passage 78 and rotating the string 32.

When it is desired to retrieve the apparatus 50 from the well, the string 32 is picked up. This raises the mandrel assembly 64 relative to the anchoring device 58. A latch assembly 110 having outwardly extending keys 114 eventually engages an internal profile 112 formed in the anchoring device 58. A sufficient axial force applied upwardly to the anchoring device 58 will release the keys 68 of the latch assembly 66 from the profile 70, permitting the apparatus 50 to be retrieved from the well.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of controlling displacement of a cutting device conveyed on a tubular string in a subterranean well, the method comprising the steps of:

interconnecting an apparatus in the tubular string, the apparatus including an axial advancement device and an anchoring device;

actuating the anchoring device to anchor the apparatus in the well;

applying a pressure differential to the advancement device, thereby displacing the cutting device relative to the apparatus; and operating the cutting device to cut a structure in the well, the structure being positioned at a wellbore intersection in the well.

2. The method according to claim 1, wherein the pressure differential applying step further comprises circulating fluid through the apparatus.

3. The method according to claim 1, wherein the operating step further comprises flowing fluid through a mud motor attached to the apparatus and the cutting device, thereby rotating the cutting device.

4. The method according to claim 3, wherein the fluid flowing step also applies the pressure differential to the advancement device to displace the cutting device.

5. The method according to claim 1, wherein the actuating step further comprises both axially and rotationally anchoring the apparatus in the well.

6. A method of controlling displacement of a cutting device conveyed on a tubular string in a subterranean well, the method comprising the steps of:

interconnecting an apparatus in the tubular string, the apparatus including an axial advancement device and an anchoring device;

actuating the anchoring device to anchor the apparatus in the well, including engaging a latch assembly of the anchoring device with a profile formed in a casing string in the well;

applying a pressure differential to the advancement device, thereby displacing the cutting device relative to the apparatus; and operating the cutting device to cut a structure in the well.

7. The method according to claim 6, wherein the pressure differential applying step further comprises actuating a clutch assembly of the apparatus to rotationally disconnect the tubular string from the latch assembly after the engaging step.

8. A method of controlling displacement of a cutting device conveyed on a tubular string in a subterranean well, the method comprising the steps of:

interconnecting an apparatus in the tubular string, the apparatus including an axial advancement device and an anchoring device;

actuating the anchoring device to anchor the apparatus in the well;

applying a pressure differential to the advancement device, thereby displacing the cutting device relative to the apparatus, the applying step including flowing fluid through an orifice attached to a piston of the advancement device, thereby creating the pressure differential across the piston; and operating the cutting device to cut a structure in the well.

9. A method of controlling displacement of a cutting device conveyed on a tubular string in a subterranean well, the method comprising the steps of:

interconnecting an apparatus in the tubular string, the apparatus including an axial advancement device and an anchoring device;

actuating the anchoring device to anchor the apparatus in the well;

applying a pressure differential to the advancement device, thereby displacing the cutting device relative to the apparatus; and operating the cutting device to cut a structure in the well, including rotating the tubular string, thereby rotating the cutting device.

10. A method of controlling displacement of a cutting device conveyed on a tubular string in a subterranean well, the method comprising the steps of:

interconnecting an apparatus in the tubular string, the apparatus including an axial advancement device and an anchoring device;

actuating the anchoring device to anchor the apparatus in the well;

applying a pressure differential to the advancement device, thereby displacing the cutting device relative to the apparatus;

operating the cutting device to cut a structure in the well; and metering fluid through an orifice of the apparatus, thereby controlling a rate of displacement of the cutting device.

11. A system for controlling displacement of a cutting device in a cutting operation in a subterranean well, the system comprising:

the cutting device interconnected at a lower end of a tubular string; and an apparatus interconnected in the tubular string above the cutting device, the apparatus including an anchoring device operative to anchor the apparatus in the well, and an advancement device responsive to a pressure differential in the apparatus, the advancement device being operative to control axial displacement of the cutting device relative to the apparatus, the cutting device being displaced into contact with a structure positioned at a wellbore intersection in the well.

12. The system according to claim 11, wherein the advancement device includes a piston reciprocably received in a bore of the apparatus, the piston displacing in response to the pressure differential being applied across the piston.

13. The system according to claim 12, wherein the piston is connected to the cutting device, so that the cutting device displaces with the piston.

14. The system according to claim 12, wherein the anchoring device includes a latch assembly.

15. The system according to claim 14, wherein the latch assembly both axially and rotationally anchors the apparatus in the well.

16. A system for controlling displacement of a cutting device in a cutting operation in a subterranean well, the system comprising:

the cutting device interconnected at a lower end of a tubular string; and an apparatus interconnected in the tubular string above the cutting device, the apparatus including an anchoring device operative to anchor the apparatus in the well, and an advancement device responsive to a pressure differential in the apparatus, the advancement device being operative to control axial displacement of the cutting device relative to the apparatus, the advancement device including a piston reciprocably received in a bore of the apparatus, the piston displacing in response to the pressure differential being applied across the piston, the piston having an orifice formed therethrough, and the pressure differential being created by fluid flow through the orifice.

17. A system for controlling displacement of a cutting device in a cutting operation in a subterranean well, the system comprising:

the cutting device interconnected at a lower end of a tubular string; and an apparatus interconnected in the tubular string above the cutting device, the apparatus including an anchoring device operative to anchor the apparatus in the well, and an advancement device responsive to a pressure differential in the apparatus, the advancement device being operative to control axial displacement of the cutting device relative to the apparatus, the advancement device including a piston reciprocably received in a bore of the apparatus, the piston displacing in response to the pressure differential being applied across the piston, the anchoring device including a latch assembly, and the latch assembly including a key configured for engagement with an internal profile formed in the well.

18. A system for controlling displacement of a cutting device in a cutting operation in a subterranean well, the system comprising:

the cutting device interconnected at a lower end of a tubular string; and an apparatus interconnected in the tubular string above the cutting device, the apparatus including an anchoring device operative to anchor the apparatus in the well, and an advancement device responsive to a pressure differential in the apparatus, the advancement device being operative to control axial displacement of the cutting device relative to the apparatus, the advancement device including a piston reciprocably received in a bore of the apparatus, the piston displacing in response to the pressure differential being applied across the piston, the anchoring device including a latch assembly, and the apparatus further including a clutch assembly which selectively rotationally connects and disconnects the latch assembly and the tubular string.

19. The system according to claim 18, wherein the clutch assembly is actuated by the pressure differential in the apparatus.

20. A system for controlling displacement of a cutting device in a cutting operation in a subterranean well, the system comprising:

the cutting device interconnected at a lower end of a tubular string; and an apparatus interconnected in the tubular string above the cutting device, the apparatus including an anchoring device operative to anchor the apparatus in the well, and an advancement device responsive to a pressure differential in the apparatus, the advancement device being operative to control axial displacement of the cutting device relative to the apparatus, and the advancement device including an orifice, displacement of the cutting device being controlled by metering fluid through the orifice in response to the pressure differential in the apparatus.

21. Apparatus for controlling displacement of a cutting device in a subterranean well, the apparatus comprising:

an advancement device responsive to a pressure differential in the apparatus to axially displace the cutting device relative to the apparatus, the cutting device being displaced into contact with a structure positioned at a wellbore intersection in the well; and an anchoring device configured to anchor the apparatus in the well.

22. The apparatus according to claim 21, wherein the advancement device includes a piston which displaces in response to the pressure differential being applied across the piston.

23. The apparatus according to claim 21, wherein the anchoring device is further configured to axially and rotationally anchor the apparatus in the well.

24. Apparatus for controlling displacement of a cutting device in a subterranean well, the apparatus comprising:

an advancement device responsive to a pressure differential in the apparatus to axially displace the cutting device relative to the apparatus, the advancement device including a piston which displaces in response to the pressure differential being applied across the piston, the piston including a flow restricting orifice formed therethrough, fluid flow through the orifice creating the pressure differential across the piston; and an anchoring device configured to anchor the apparatus in the well.

25. Apparatus for controlling displacement of a cutting device in a subterranean well, the apparatus comprising:

an advancement device responsive to a pressure differential in the apparatus to axially displace the cutting device relative to the apparatus;

an anchoring device configured to anchor the apparatus in the well; and a bearing assembly which transfers an axial load from the advancement device to the anchoring device while permitting relative rotation between the advancement and anchoring devices.

26. The apparatus according to claim 25, further comprising a clutch assembly which selectively permits and prevents relative rotation between the anchoring device and the advancement device across the bearing assembly.

* * * * *